United States Patent [19]

Gartung

[11] 4,070,803

[45] Jan. 31, 1978

[54] SUPPORTIVE ACCESSORY UNITS FOR MODULAR WALL PANELS

[76] Inventor: Clifford W. Gartung, 215 Via Dijon, Newport Beach, Calif. 92660

[21] Appl. No.: 703,085

[22] Filed: July 6, 1976

[51] Int. Cl.[2] ..... A47G 29/02

[52] U.S. Cl. ..... 52/36; 52/627; 108/108; 211/193; 248/243

[58] Field of Search ..... 52/36, 27, 627; 108/108; 248/243; 211/193

[56] References Cited

U.S. PATENT DOCUMENTS

| | | | |
|---|---|---|---|
| 1,055,050 | 3/1913 | Knape | 248/243 |
| 1,220,021 | 3/1917 | Smyrk | 52/27 |
| 1,852,598 | 4/1932 | Vogt | 248/243 |
| 2,679,700 | 6/1954 | Urbain | 52/36 X |
| 3,634,987 | 1/1972 | Huguet | 52/627 X |
| 3,748,799 | 7/1973 | Tough et al. | 52/627 X |
| 3,807,102 | 4/1974 | Albinson | 52/36 |
| 3,834,101 | 9/1974 | Wilder et al. | 52/627 X |
| 3,849,950 | 11/1974 | Albinson | 52/27 |
| 3,856,148 | 12/1974 | Olinick | 108/108 |
| 3,934,382 | 1/1976 | Gartung | 52/241 |

FOREIGN PATENT DOCUMENTS

| | | | |
|---|---|---|---|
| 549,083 | 11/1942 | United Kingdom | 248/243 |
| 902,828 | 8/1962 | United Kingdom | 52/27 |

*Primary Examiner*—Leslie Braun
*Attorney, Agent, or Firm*—Jackson & Jones

[57] ABSTRACT

A supporting accessory unit such as a shelving unit is adapted for use on a modular wall panel having a peripheral support frame with a decorative planar surface. The shelving unit includes a support assembly capable of being removably attached to the interior of the modular peripheral frame without any additional fasteners. The support assembly includes an upper support shoulder and a force-bearing surface adjacent a U-shaped support bracket. The support bracket is capable of holding cantilevered shelf supports for receiving the actual shelving panel. Alternatively, a removable hook assembly can be suspended from the interior of the wall support frame.

13 Claims, 9 Drawing Figures

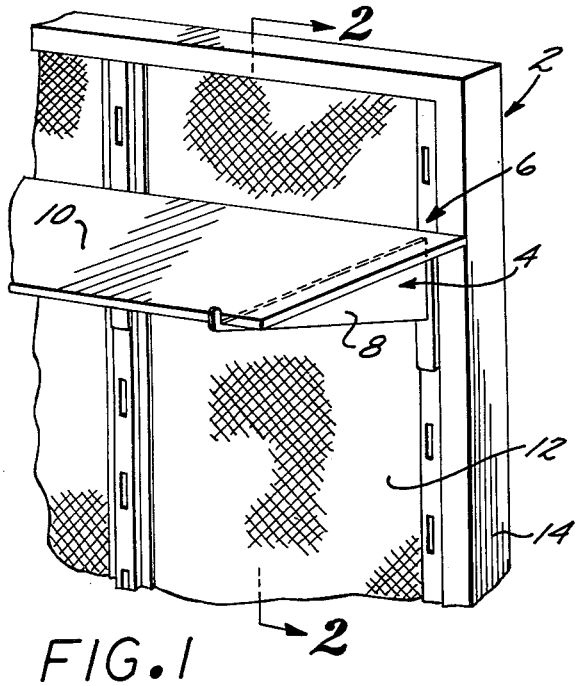
FIG. 1
FIG. 3
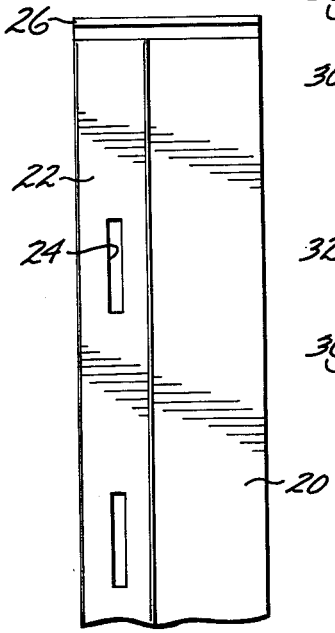
FIG. 5
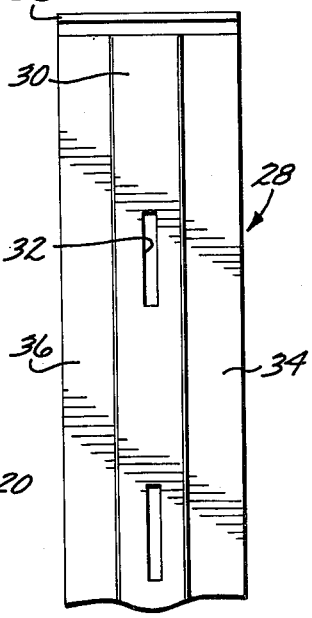
FIG. 2
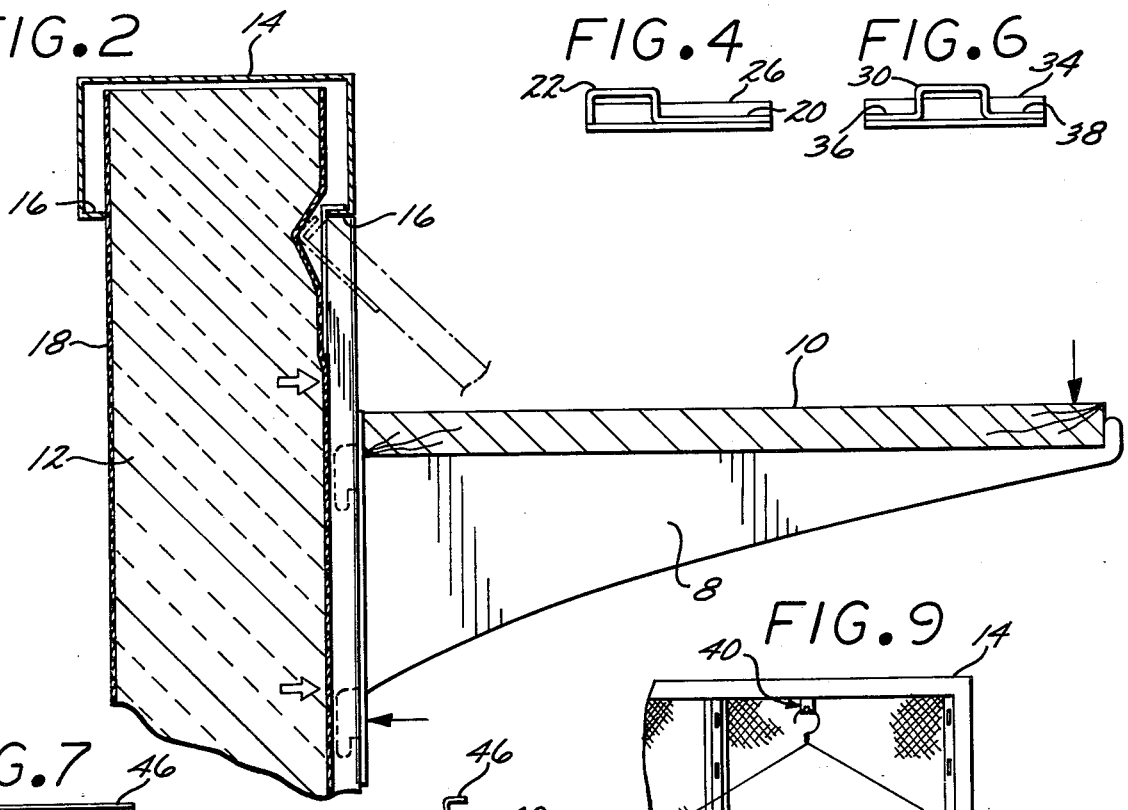
FIG. 4
FIG. 6
FIG. 7
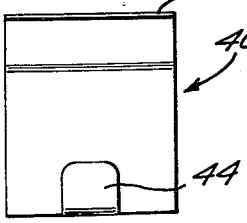
FIG. 8
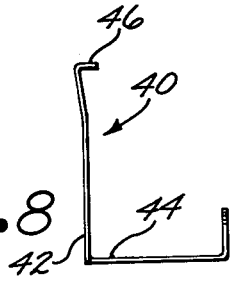
FIG. 9
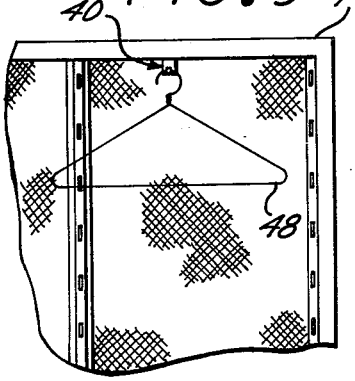

SUPPORTIVE ACCESSORY UNITS FOR MODULAR WALL PANELS

BACKGROUND OF THE INVENTION

1. Field of the Invention

The present invention is directed to a supportive accessory for use on panel wall modules and more particularly to removable shelving and wall hanger bracket assemblies.

2. Description of the Prior Art

Modern offices have frequently utilized removable interior wall partitions to accommodate flexible office planning. In fact, many new building structures are now designed to provide permanent load-bearing exterior walls while relying upon semi-permanent or mobile non-load bearing interior partition walls for a subjective determination of office floor plans. Frequently the mobile wall partitions include a sheet or pad of a sound absorbing material, for example a sheet of fibrous material such as glass fibers. A rigid frame structure surrounds the perimeter of the sound absorbing panel, as disclosed in the Gartung U.S. Pat. No. 3,934,382. The sound absorbing panel is capable of supporting a decorative surface but generally is not capable of supporting any additional direct weight, such as shelving, coat hangers, etc.

As can be readily appreciated, it is frequently necessary in an office environment to provide both shelving and various other appendant items to a modular wall panel, see the Lovitz U.S. Pat. No. 3,477,679. To date, the prior art has primarily relied upon a structural modification of the peripheral rigid support frame; for example, by providing a column of slotted apertures along one or more side frame supports. The shelving units are then directly attached to the rigid frame structure. This, however, mars the esthetic appearance of the total wall panel and does not permit optional inclusion of the shelving feature, that is the wall panel will be provided with a permanent column of apertures to accommodate shelving or else it will not be able to support a shelf.

The prior art to date has not provided a relatively inexpensive and esthetically pleasing form of removable supportive attachments that can be utilized with modular wall panels.

SUMMARY OF THE INVENTION

The present invention is directed to supportive accessory units capable of being removably connected to modular wall panels. The modular wall panels have relatively rigid frames that support a compressible panel member such as a pad of glass fibers. The support assembly includes a relatively rigid force-bearing member having a support shoulder extending outward from the force-bearing member and capable of connecting with the interior of the rigid wall frame. A supporting hook or cantilevered member can extend from the rigid force-bearing member for supporting appended articles.

In a shelving application, a U-shaped support bracket has a plurality of apertures and a support shoulder extending outward from a force-bearing member. The shelving support assembly can be mounted on a modular wall panel without any additional fasteners. The compressible panel member is depressed and the support shoulder is inserted between the compressible panel member and a peripheral rim of the modular wall panel frame. The force-bearing member extends adjacent the U-shaped support bracket and is further slid under an adjacent vertical support rim of the wall frame.

An alternative hook support assembly is also provided having a non-planar bearing area attached to a support shoulder and hook. The hook assembly can be removably attached to the modular wall panel to act as a coat hook. Each of the support assemblies can be quickly attached or removed and are structurally designed to complement the modular wall panel.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is a front partial perspective view of a shelving support assembly of the present invention;

FIG. 2 is a cross-sectional view taken along the plane 2—2 of FIG. 1;

FIG. 3 is a plan view of one form of a shelving support assembly base;

FIG. 4 is an end view of the shelving support base of FIG. 3;

FIG. 5 is a plan view of a modified shelving support assembly base;

FIG. 6 is an end view of the shelving support base of FIG. 5;

FIG. 7 is a plan view of a coat hook support assembly;

FIG. 8 is a side view of the coat hook support assembly; and

FIG. 9 is a perspective view of the coat hook support assembly of present invention.

DESCRIPTION OF THE PREFERRED EMBODIMENT

The following specification taken in conjunction with the drawing sets forth the preferred embodiment of the present invention in such a manner that any person skilled in the modular wall panel arts can use the invention. The embodiments of the invention disclosed herein are the best modes contemplated by the inventor for carrying out his invention in a commercial environment, though it should be understood that various modifications can be accomplished within the parameters of the present invention.

Referring to the perspective view of FIG. 1, a portion of a modular wall panel 2 is disclosed with a removable supportive accessory unit attached. The supportive accessory unit in this embodiment is a shelving support assembly 4 which comprises essentially a support base 6, a cantilevered support member 8 and a shelving panel 10.

The modular wall panel 2 can be of the type described in the Gartung U.S. Pat. No. 3,934,382 and the disclosure material of that patent is incorporated herein by reference. For our present purpose the modular wall panel 2 includes a compressible panel member 12, for example of a glass fiber pad to provide sound absorption capability and a rigid peripheral support frame 14 of a cross-sectional U-shaped metal channel. A support rim 16 extends inward from both edges of the U-shaped channel frame 14 and bears against the panel member 12. An appropriately decorative cover member 18 such as a fabric, can be mounted on either side of the compressible panel member 12.

Referring to FIGS. 3 and 4, a plan view and end view of the support base 6 for a shelving assembly can be seen. This support base 6 comprises an elongated flat force-bearing member 20 that is attached to a U-shaped support bracket 22. The support bracket 22 has a plurality of apertures 24 extending along the length of the support base 6. The rectangular apertures 24 are designed to accommodate a male coupling member, for example on a shelf panel support member 8 as is well known in the prior art. Other forms of support attachments can be utilized, as known in the prior art, to suspend a support member 8 in an operative position for receiving a shelving panel 10.

The support base 6 further includes a support shoulder 26 extending outward from the force-bearing member 20 at one end of the U-shaped support bracket 22. Advantageously, the support bracket 22 and force-bearing member 20 can be cold pressed from a single plate of steel and the support shoulder member 26 can be tack welded or appropriately attached to complete the support base 6 assembly.

Referring to FIG. 2, the phantom lines disclose the procedure for attaching the support base 6 to a modular wall panel 2. The compressible panel member 12 has sufficient resiliency to be depressed away from the support rim 16 and permit the insertion of the support shoulder 26 into the interior of the rigid frame 14 to bear against the adjacent peripheral support rim 16. This resilient characteristic of the panel wall further permits the bearing member 20 to be slidingly inserted underneath an adjacent vertical support rim so that only the U-shape support bracket 22 will be visible. The height of the support shoulder 26 is approximately the same distance as that of the support rim 16 and thereby permits the support bracket 22 to be approximately flush with the adjacent frame 14. Obviously, the support base 6 can be appropriately shaped or decorated in any manner to enhance the ornamental effect. The resilient force of the compressible panel member 12 maintains the position of the support base 6 on the modular wall panel 2 without the necessity of any additional fasteners.

As can be seen from an end view of FIG. 4, the construction of the support base 6 can be relatively simple and is thus easy and inexpensive to manufacture. The support base 6 further permits the manufacturing of a standarized frame 14 that can optionally include a supportive accessory unit without any modifications or marring of its esthetic surface.

Another embodiment of a shelving support base 28 is disclosed in FIGS. 5 and 6 and is designed to accommodate an elongated shelving panel 10 for large modular wall panel units. The shelving support base 28 includes a central U-shaped bracket 30 having a plurality of apertures 32. A bifurcated force-bearing arrangement is provided with force-bearing members or flanges 34 and 36 positioned adjacent either side of the U-shaped mounting bracket 30. A support shoulder 38 extends outward from force-bearing members 34 and 36 and across one end of the U-shaped bracket 30. The relative distance between the end of U-shaped bracket 30 and the support shoulder 38 is sufficient to permit a pivotal mounting movement similar to that disclosed in FIG. 2.

In operation, a modular wall panel 2 is assembled as described in the Gartung U.S. Pat. No. 3,934,382. In this regard a decorative compressible panel member 12 is appropriately mounted within the U-shaped frame 14 and bears against the peripheral support rim 16. The resiliency of the compressible panel member 12 is sufficient to permit selected areas of the compressible panel member 12 to be biased away from the support rim 16 and still return to its original shape. As can be seen in FIG. 2, a support base 6 of the appropriate dimensions is selected and the back surface of the support shoulder member 26 is biased against the face of the compressible panel member 12 adjacent an appropriate portion of the frame support rim 16. The compressible panel member 12 is resiliently depressed and permits the support shoulder member 26 to be inserted within the interior of the U-shaped channel of the frame 14. Specifically, the support shoulder member 26 traversely extends outward from a plane containing the force-bearing member 20 and rests on the interior surface of the peripheral support rim 16 to hold the entire direct downward force of the shelving support assembly 4. The support base 6, after its mounting on the support rim 16, is pivoted to rest against the face of the compressible panel member 12. An inward and horizontal force is then appropriately exerted against the support base 6 to slide the force-bearing member 20 between the depressed compressible panel member 12 and a horizontal peripheral portion of the support rim 16. This force is continued until the support bracket 22 lies adjacent and approximately flushed with the vertical side surface of the frame 14. With shelving of relatively moderate length, a second support base 6 having a force-bearing member extending on the other side of the support bracket 22, that is a mirror image of the first support base 6, can be mounted on the other side of the modular wall panel.

As both an alternative embodiment and a supplemental embodiment of the support base 6 of FIG. 3, the support base 28 disclosed in FIGS. 5 and 6 can be utilized. For shelving of substantial length, an intermediate support between the respective vertical support posts of the frame 14 is required. In this regard, a support base 28 can be mounted in the same manner as support base 6 by depressing the compressible panel member 12 and inserting the support shoulder 38 onto the support rim 16. The U-shape bracket 30 contains a plurality of aligned apertures 32 with adjacent force-bearing members 34 and 36 on either side of the bracket.

With the support bases appropriately mounted on the modular wall panel 2, a conventional support member 8 can be appropriately mounted in the respective apertures and conventional shelving panel 10 can be supportingly positioned to form the complete shelving assembly. As can be readily appreciated from FIGS. 5 and 6, the shelving support base 28 disclosed therein can replace the support bases 6 since the force-bearing members 34 and 36 can be optionally slid under either a right or left vertical support post on the frame 14. Thus component parts and costs can be reduced by the use of a universal shelving support base 28. The only impediment is the visibility of the uncovered force-bearing member away from the vertical side frame post.

An alternative embodiment of the present invention is disclosed in FIGS. 7–9, in the form of a hook assembly 40. The hook assembly includes a non-planar force-bearing member 42 connected to a cantilevered support hook 44 and a support shoulder 46. As can be appreciated the actual configuration of the support shoulder 46 can be varied. The hook assembly 40 is advantageously used to suspend articles parallel to the modular wall panel 2, for example as a cloak rack. As can be seen in FIG. 9, a hanger 48 can be optimumly mounted on the support hook 44.

The mounting of the hook assembly 40 onto the modular wall panel frame 14 is similar to that of the shelving support bases 6 and 28. The support shoulder 46 is pressed against the panel member 12 to permit the entry of the support shoulder 46 into the interior of the frame of the U-shape channel frame 14 to rest against the support rim 16. This mounting operation can be easily reversed for disassembly in an extremely short period of time.

The present invention offers extremely simplified and economical supportive accessory units for modular wall panels that do not require any additional fasteners nor any modification of the relatively rigid frame support for modular wall panels. A minimal amount of time is required for assembling or disassembling the accessory unit without any destruction or marring of the modular wall panel. Various modifications of the generic concepts of this invention are possible and accordingly the scope of the present invention should be determined solely from the following claims.

What is claimed is:

1. In combination with a modular wall panel including a rigid frame having a U-shaped channel with at least one peripheral support rim and a compressible panel member mounted in the U-shaped channel frame and bearing on the support rim, the improvement comprising a shelving support assembly including;

a U-shaped support bracket having a plurality of apertures, an elongated side flat force bearing member and an upper horizontal support shoulder extending outward from the side force-bearing member at one end of the U-shaped support bracket, the compressible panel member bearing against the U-shaped support bracket, and the side force bearing member to hold the upper support shoulder against the frame support rim, the side force bearing member further extending under an adjacent peripheral support rim and bearing against the edge of the support rim, the shelving support assembly is removably mounted on the modular wall panel by depressing the compressible panel member and sliding the upper support shoulder onto a horizontal support rim and also by sliding the side force bearing member behind an adjacent vertical support rim.

2. The invention of claim 1 wherein the force bearing member and the U-shaped support bracket are stamped from a single plate of metal.

3. The invention of claim 2 wherein the support shoulder comprises an L-shaped member.

4. The invention of claim 3 wherein the distance between the surface of the side force bearing member and the top of the U-shaped support bracket approximates the width of the peripheral support rim whereby the shelving assembly can be mounted approximately flush with the rigid wall panel frame.

5. In combination with a modular wall panel having a horizontal and vertical peripheral relatively rigid frame, the frame having approximately a U-shaped cross-section which surrounds an edge portion of a resiliently compressible panel member forming the major surface of the wall panel, the frame including an inwardly extending support rim, the improvement comprising;

a relatively rigid force bearing member removably extending between the frame and the resilient compressible panel member;

holding means extending from the force bearing member to provide a load bearing supportive connection with only the interior of the rigid frame member including an upper horizontal support member engaging the interior of the horizontal rigid frame to coact with the support rim and a side vertical support member engaging the interior of a vertical rigid frame, and support means connected to the rigid force bearing member for supporting appended articles such as shelving and the like, the force bearing member is removably mounted by depressing the resilient compressible panel member away from the rigid frame and inserting the horizontal support member between the compressible panel member and the horizontal rigid frame and the side vertical support member between the compressible panel member and the vertical rigid frame, the compressible panel member is then permitted to relax and bear against one side of the removably force bearing member to bias the horizontal and vertical support members outwardly against the rigid frame to provide the load bearing supportive connection.

6. The invention of claim 5 wherein the force-bearing member is bifurcated and extends adjacent both sides of the support means.

7. The invention of claim 5 wherein the support means includes a U-shaped channel having a plurality of apertures.

8. In combination with a modular wall panel having a peripheral relatively rigid frame, the frame having substantially a U-shaped cross-section with an inwardly extending support rim, the frame surrounds an edge portion of a resilient compressible panel member forming the major surface of the wall panel, the improvement comprising;

a relatively rigid force bearing member removably extending between the frame and the resilient panel member having a support bracket an upper horizontal support shoulder extending across at least a portion of the support bracket and a side vertical support member, the upper horizontal support shoulder having a configuration complementary to that of the frame support rim providing a load bearing supportive connection with only the inwardly extending support rim on the interior of the rigid frame member and an operative position substantially flush with the exterior of the rigid frame, the upper horizontal support shoulder mounted directly on the frame support rim and in operative bias contact with the resilient compressible panel to urge the upper horizontal support shoulder adjacent a horizontal frame wall, the side vertical support member resiliently biased by the resilient compressible panel against the edge of a vertical wall support rim, and a supporting portion extending from the support bracket for supporting appended articles such as shelving and the like, the force bearing member is removably mounted by depressing a portion of the resilient compressible panel member, spaced inward from its peripheral edge, away from the rigid frame and inserting the force bearing member therebetween, the compressible panel member is then permitted to relax and bear against one side of the removable force bearing member to bias the upper support shoulder against the support rim to provide the load bearing supportive connection and to further bias the side vertical support member against the interior of the rigid frame.

9. The invention of claim 8 wherein the side vertical support member includes a side force bearing flange extending between a vertical portion of the frame and the resilient panel member.

10. The invention of claim 8 wherein the side vertical support member includes a pair of side force bearing flanges.

11. The invention of claim 8 wherein the rigid force bearing member has a plurality of connecting apertures positioned between and relatively above the side force bearing flanges.

12. The invention of claim 8 wherein the rigid force bearing member has a plurality of connecting apertures positioned to one side and relatively above the bearing flange.

13. An improved modular wall panel with supportive accessory units comprising;

a peripheral relatively rigid vertical and horizontal frame having an approximately U-shaped cross-sectional wall with an interior inwardly extending support rim;

a resilient compressible panel member mounted within the rigid frame and substantially in contact about the wall periphery with the inwardly extending support rim, and a relatively rigid force bearing member having a support bracket, an upper horizontal support shoulder extending across at least a portion of the support bracket and a side vertical support flange, the upper support shoulder mounted directly on the frame support rim and in operative bias contact with the resilient compressible panel to urge the upper support shoulder adjacent the horizontal frame wall, the side support flange resiliently biased by the resilient compressible panel against the edge of a vertical wall support rim, whereby appended articles can be connected to the support bracket.

* * * * *